United States Patent [19]

Ong

[11] Patent Number: 4,584,124

[45] Date of Patent: Apr. 22, 1986

[54] STABLE THICKENER DISPERSIONS WHICH ACT AS CARRIERS

[75] Inventor: Sienling Ong, Hofheim am Taunus, Fed. Rep. of Germany

[73] Assignee: Hoechst Aktiengesellschaft, Fed. Rep. of Germany

[21] Appl. No.: 629,367

[22] Filed: Jul. 10, 1984

[30] Foreign Application Priority Data

Jul. 12, 1983 [DE] Fed. Rep. of Germany ..... 3325083

[51] Int. Cl.[4] ..... B01J 13/00; C09B 67/10; C09B 67/40

[52] U.S. Cl. ..... 252/308; 8/528; 252/315.1; 252/315.3; 252/356; 524/923

[58] Field of Search ..... 252/308, 315.1, 356; 8/528; 524/923

[56] References Cited

U.S. PATENT DOCUMENTS 2,798,053 7/1957 Brown ..... 252/174.18 X
3,228,842 1/1966 Markland et al. ..... 252/315.1 X
3,811,904 5/1974 Zola ..... 252/308 X
3,923,457 12/1975 Ong et al. ..... 8/528
4,183,917 1/1980 Iwao et al. ..... 252/315.1 X

FOREIGN PATENT DOCUMENTS 596138 4/1960 Canada ..... 8/528
2728767 1/1979 Fed. Rep. of Germany .

*Primary Examiner*—Richard D. Lovering
*Attorney, Agent, or Firm*—Connolly and Hutz

[57] ABSTRACT

In order to counteract the electrolyte sensitivity of synthetic thickeners they are used together with natural thickeners. These mixtures are in turn associated with other problems which in many cases can lead to an impairment of the appearance of the goods in dyeings of polyester fibers with disperse dyestuffs.

According to the invention these problems can be bypassed if the thickener dispersions, in addition to the thickener mixtures of synthetic and natural products, contain as the continuous phase solvents from the series of the alkyloxypropylates.

3 Claims, No Drawings

STABLE THICKENER DISPERSIONS WHICH ACT AS CARRIERS

It is known to use in the preparation of print pastes for textile printing not only synthetic but also natural gel-forming substances for stiffening the aqueous dyestuff solutions or dyestuff dispersions responsible for the colored patterns.

However, as is also known to those skilled in the art not every gel-forming substance is suitable for this purpose in any print paste. The decision about which thickener should be used in a certain print paste is governed to a large extent as inter alia by points such as (a) the ionic character of the dyestuffs,
(b) the electrolyte content of the print paste,
(c) the pH of the print paste,
(d) the fixing conditions,
(e) the washing-off properties of the finished prints,
(f) the washing-off properties of the print paste residues,
(g) the color yield and
(h) the available machinery at the printer's.

In practice, the thickneners preferred to date for preparing electrolyte-containing print pastes are predominantly natural gel-forming substances, such as alginates or Guar bean flour, starch or cellulose derivatives. In addition to the criteria already mentioned, the ultimate choice is of course additionally governed by commercial considerations.

By contrast, the synthetic gel-forming macromolecules of a molecular weight of up to 1,500,000 are these days used as thickeners in the main in so-called pigment printing. In this special type of textile printing—which in principle requires no afterwash—the ease with which the gel-forming molecule of the synthetic thickening can be manipulated is actually welcome. Their viscosity-increasing action can be controlled by specific manipulation on the molecule in such a way that readily printable print pastes are even produced at very low concentrations of 0.5 to 0.8 percent by weight. Moreover, since they are used in the form of the ammonium salt of the parent polycarboxylic acid, some of the ammonia bound in their molecule is lost during the fixing in hot air, and they are thus converted either to imide derivatives or back again into the free acids. As a consequence they lose their stiffening action and then no longer impair the hand of the cloth printed therewith. Even without afterwash the printed areas thus remain soft and supple.

As ideal as the resulting prints evidently appear to be, universal use of these synthetic thickeners in textile printing is nevertheless not advisable because of their existing electrolyte sensitivity. However, mixing such synthetic thickeners with natural thickeners with the intention of reducing the electrolyte sensitivity in turn brings with it the additional disadvantage of an afterwash then being required, because the printed areas become stiff in this case even if the proportion of natural thickener in the mixture is low. There is the additional fact that before the components of the mixture are mixed with each other they have to be dissolved separately in water in order to avoid lumps forming during the dissolving. But even if they are dissolved separately the synthetic thickeners still present appreciable problems. Owing to the hydrophobic properties of commercially available high molecular weight synthetic thickeners in the pulverulent polycarboxylic acid state they are difficult to disperse in water adjusted to alkaline pH.

In making up the solution by sprinkling the synthetic thickener into alkaline water an individual particle of the polymer powder will assuredly go into solution very rapidly. However, there is the danger that that at higher concentrations the particles of the powder will become bonded into sizeable agglomerates as a result of their hydrophobic character. The surface of such agglomerations of solid material is then covered with a filmlike aqueous coating which inhibits rapid moistening of the interior of the agglomerates. The formation of such agglomerates, which can eventually lead to lumps, must therefore be prevented in order to rule out long mixing cycles.

The reason long mixing in particular with high shear stirrers should be avoided is that they cause, for example, destruction of the polymers in chain form which underlie the synthetic thickeners, this destruction resulting in a permanent loss of viscosity. Furthermore, if thickener mixtures which, in addition to synthetic thickeners, also contain natural thickeners are used allowance must also be made for the fact that at temperatures above 180° C. they yellow and may even form a hornlike skin. It is known from experience that removing these yellow deposits from the cloth is difficult and frequently even impossible, and the value of the cloth is consequently reduced by a stiff hand.

A further problem which is even more serious than the stiffening effect is presented by the brittleness of the dyestuff-containing print paste film at the printed areas after the cloth has been dried in the drying chamber. This brittleness has the effect that even very small mechanical stress will lead to the splitting-off of minute colored particles. Since, in addition, polyester goods in the dry state also possess a static electric charge, these colored particles are at best deposited at usually undesirable places and, in the course of the thermosoling to fix the printed patterns, are even genuinely bonded on the cloth. The result can easily be a faulty batch.

It is thus the object of the present invention to design thickener dispersions which can be used for preparing aqueous formulations for the application of insoluble, hot-fixable dyestuffs to a hydrophobic textile material and which do not have the disadvantages described above.

This object is achieved by printing dyestuff formulations onto polyester fiber materials with thickener dispersions which, in addition to thickener mixtures of the conventional type, contain alkyloxypropylates as the continuous phase, and fixing the colorants by a customary method for polyester fibers.

The present invention thus provides stable ready-to-use thickener dispersions which act as carriers and in which the continuous phase comprises high-boiling hydrophobic solvents of the general formula (I)

$$C_nH_{2n+2-m}[O(CH_2-CH(CH_3)_{x/m}-H]_m \quad (I)$$

where n denotes an integer from 2 to 6,
m denotes an integer from 1 to 6 and
x denotes a number from 20 to 60, with the proviso that m is less than or equal to n.

The novel thickener dispersions to which this property right relates specifically comprise the following components:

(a) synthetic thickeners,
(b) natural thickeners, (c) solvents of the type of the alkyloxypropylates of the general formula (I) and (d) viscosity-regulating emulsifiers based on polyglycol esters according to German Pat. No. DE-C-2,728,867.

The synthetic thickeners of component (a) of the thickener dispersion according to the invention can be high molecular weight carboxyl-containing copolymers or polymers of the type described in, for example, U.S. Pat. Nos. 2,798,053, 3,066,118, 2,967,174 and 2,977,334; in German Offenlegungsschriften Nos. DE-A-2,534,792, 2,822,423, 2,754,058, 2,214,945 and 1,595,727; or in British Pat. Nos. GB-A-715,412 and 1,069,637.

As a rule the thickener dispersions according to the invention can contain up to 25 percent by weight of these synthetic thickeners (a).

The natural thickeners of component (b) of the thickener dispersion according to the invention should be of the type which readily dissolves in water at room temperature. However, some of these natural raw materials must be chemically modified before they are used as a component in the thickener dispersion according to the invention, in order to ensure better harmonization of the properties of the components.

Examples of such suitable natural thickener raw materials are seaweed extracts, plant exudates, gel-forming substances from seeds and roots, gel-forming substances of microbiological fermentation, and modified cellulose or starch. These collective terms are to be understood as meaning, inter alia, agar agar, alginates, carragenates, guar bean flours, tragacanth, crystal gum, carob bean flour, hydroxyalkyl guaranates such as hydroxyethyl or hydroxypropyl guaranates, carboxymethyl guaranates, carboxymethyl bean flour ether, carboxymethyl hydroxypropyl guaranate, hydroxyethylcellulose, hydroxypropylcellulose, methylcellulose, hydroxypropylmethylcellulose and the like.

The abovementioned modification of natural thickeners for the purposes of this invention is conducted by known processes. For instance, gelactomannanes can be depolymerized by the alkaline oxidation, by acid hydrolysis, by controlled enzymatic degradation or by heat treatment.

The alkyl or carboxymethyl derivatives of cellulose or starch are obtained by treating these raw materials under alkaline conditions with, for example, alkyl halides or an alkali metal salt of chloroacetic acid.

The thickener dispersions according to the invention can also contain up to 25 percent by weight of these natural thickeners (b).

Component (c) of the thickener dispersions according to the invention can only be solvents of the general formula (I) given above, since only these compounds of the alkyloxypropylate type, if used together with the emulsifier referred to as component (d), can guarantee not only that the problems, already mentioned at the outset, of the mixtures of natural and synthetic products which are wellknown for these purposes are overcome but also that the new thickener dispersions have a long shelf life. Furthermore, this mixture of (c) and (d) additionally has a color-intensifying action on disperse dyestuffs which are fixed on polyester fabrics in a steam-containing high-temperature atmosphere. These favorable properties are the result of a balanced hydrophilicity/organophilicity ratio of the solvent/emulsifier mixture used in this instance.

If purely organophilic hydrocarbons such as paraffin oils, xylenes, hexanes and the like or dioctyl phthalates were used in place of solvent component (c) used according to the invention, the thickener dispersions prepared therefrom, however, showed sedimentation within a short time, because both the salts of component (a) and component (b) are insoluble in hydrocarbon or ester. Emulsifier (d) used according to the invention is likewise insufficiently organophilic to be soluble in hydrocarbon or ester. The pasty sediment comprising components (a), (b) and (d) then becomes hard within a few days and needs to be ground first before it becomes usable again. The mixture of the present invention, which comprises 4 components, by contrast, remains pasty. The print pastes which contain hydrocarbons or dioctyl phthalate in place of solvent component (c) surprisingly produce inferior color yields on polyester fiber material than do those print pastes prepared by means of the thickener dispersion according to the invention.

The solvents defined by the general formula (I) are derived from alkyloxypropylates and as such are reaction products of alkanols with propylene oxide. However, these solvents used alone or in the form of mixtures as component (c) need to be chosen so that they (1) remain liquid at up to −5° C., (2) contain no more than 3% by weight of water at 23±1° C. and at 75% relative humidity, (3) possess a specific heat of about 1.95 kj/kg.K, (4) be highly compatible with ethylene glycol terephthalic acid ester, so that they do not attack the polyester fibers at the temperatures and within the time which are required to fix disperse dyestuffs on these substrates, (5) do not evaporate at temperatures up to 220° C., (6) possess a viscosity of 20 to 240 cSt (corresponding to $10^{-2}$ $cm^2/s$) at 50° C., (7) possess a density of 0.981 to 1.000 $g/cm^3$ at 20° C. and of 0.957 to 0.977 $g/cm^3$ at 50° C., (8) possess an average molecular weight of 700 to 2,300

(9) possess a vapor pressure below 0.01 mbar at 20° C.,

(10) possess a flash point above 225° C.,

(11) possess an ignition temperature above 275° C. and

(12) possess an oral toxicity LD 50 (rats) of at most 5 g/kg.

These conditions are met for example by propylene glycol monobutyl ether.

These solvents (c) amount to 35 to 75, preferably between 45 and 55, percent by weight of the thickener dispersions according to the invention. Preferred solvents of the general formula (I) are derived from monohydric alcohols, i.e. have formulae in which m represents 1.

The emulsifiers which can be used as component (d) of the thickener dispersions according to the invention are in particular polyglycol esters of the general formula (II)

$$(CH_3)_a-C\left[CH_2-(O-CHZ-CH_2)_y-\begin{matrix}-(OH)_b\\-(O-CO-R)_{4-a-b}\end{matrix}\right]_{4-a} \quad (II)$$

in which

R is an open-chain aliphatic radical having 9 to 19, preferably 11 to 17, carbon atoms;

Z represents hydrogen and methyl in a ratio of $H:CH_3$ of 2:1 to 4:1, preferably 2.5:1 to 3.5:1;

a is zero or 1, b is 1 to 1.5 and (4-a).y is 150 to 300, preferably 200 to 250.

In particular, R—CO— denotes oleyl, the average ratio of $H:CH_3$ in the Z radical is 3:1, a denotes zero, b denotes about 1.1 and (4-a).y denotes about 210. Such emulsifiers of the general formula (II) and processes for their preparation are described in German Pat. No. DE-C-2,728,767.

Emulsifier (d) is added to the thickener dispersion according to the invention in amounts between 10 and 100 g preferably 50 g, per kilogram.

The novel thickener dispersion is prepared by incorporating a ground and sieved component (a) a little at a time with continuous stirring into component (c). When the two components are thoroughly mixed, ammonia gas is introduced with cooling into the reaction mass until the polycarboxylic acid is completely neutralized. Thereupon a thoroughly ground and sieved component (b) is added to the stirred mass a little at a time. Thereafter the speed of the stirrer is raised slightly, and emulsifier (d) is then added dropwise with intensive stirring. After further stirring the thickener dispersion is storable and ready to use.

EXAMPLE 1

480 g of a propylene glycol monobutyl ether having an average molecular weight of about 700 and 100 g of a propylene glycol monobutyl ether having an average molecular weight of about 2,300 are mixed by mechanical stirring until homogeneous. To the mixture thus prepared was then added a little at a time 200 g of a polycarboxylic acid having an average molecular weight of 1,500,000 and having been prepared in accordance with U.S. Pat. No. 2,798,053, and this synthetic thickener was carefully incorporated into the stirred mass.

Ammonia gas was then passed into this batch with cooling of the reaction mass, in order to neutralize the polycarboxylic acid contained therein. When the neutralization process was complete 170 g of bleached guar bean meal was then added as a natural thickener, again a little at a time, and were evenly dispersed in the stirred mass with continued stirring.

After the homogeneity of the stirred mass had been ascertained beforehand by inspection between two glass plates, the product of the above measures finally had added to it, dropwise, and with more vigorous stirring, 50 g of the emulsifier based on pentaerythritol poly(ethylene/propylene) glycol trialkyl ester according to the use example of German Pat. No. DE-C-2,728,767, to obtain in this way 1000 g of the thickener dispersion according to the invention.

EXAMPLE 2

25 g of the thickener dispersion obtained in Example 1 were dissolved with stirring in 975 ml of distilled or demineralized water. This gave a ready-to-use stock thickening free of lumps.

EXAMPLE 3

A print paste prepared from

| | |
|---|---|
| 60 g | of the dye Disperse Blue 56 of C.I. No. 63,285, in commercially available non-ionically finished form, |
| 500 g | of the stock thickening of Example 2 and |
| x g | of water or thickener as balance |

-continued

| | |
|---|---|
| 1000 g | of print paste |

was used to print a polyester fabric. After the dyestuff had been fixed at 180° C. in an HT steamer in the course of 6 minutes, the fabric was rinsed with water and finished by soaping off.

The result was a brilliant, blue print.

EXAMPLE 4

A fabric knitted from texturized polyester fibers was printed with a print paste of the following composition

| | |
|---|---|
| 60 g | of the commercially available dyestuff Disperse Yellow 54 of C.I. No. 47,020, |
| 500 g | of the stock thickening from Example 2, |
| 10 g | of the emulsifier according to the use example of German Patent DE-C-2,728,767 and |
| x g | of balance |
| 1000 g | of print paste |

was then steamed at 170° C. in an Ht steamer for 8 minutes to fix the dyestuff, and was finally rinsed with water and conventionally soaped off.

The result was brilliant yellow prints without affected hand.

EXAMPLE 5

A cellulose triacetate fabric was printed with a print paste of the following composition

| | |
|---|---|
| 60 g | of the commercially available but low-electrolyte dyestuff Disperse Red 73 of C.I. No. 11,116, |
| 500 g | of the stock thickening of Example 2 |
| x g | |
| 1000 g | of print paste |

was given an interim dry and then treated at 190° C. with hot air for 45 seconds to fix the dyestuff, and then rinsed with water, soaped off as customary and finally rinsed once more.

The result was brilliant red prints having good fastness properties.

EXAMPLE 6

A polyester fabric was printed with a print paste of the following composition

| | |
|---|---|
| 5 g | of the dyestuff Disperse Blue 56 of C.I. No. 63,285, in commercially available form, and |
| 500 g | of the stock thickening of Example 2 and |
| x g | of balance |
| 1000 g | of print paste |

was dried and was then steamed at 120° C. in an HT steamer for 7 minutes to fix the dyestuff.

Afterwards it was possible to process the fabric printed pale blue in the above manner without rinsing and washing, directly into pieces of clothing which were wearable without resulting colored abrasion or troublesome smudging of the print pattern on the skin. Nor did the hand of the printed areas differ very much at all from that of the rest of the unprinted goods.

I claim:

1. A stable ready-to-use thickener dispersion which acts as a carrier, for the manufacture of aqueous formulations suitable for printing water-insoluble, hot-fixable disperse dyestuffs onto a textile hydrophobic fiber material, which comprises a combination having as the ingredients:

(a) a synthetic thickener based on a high molecular weight carboxylic polymer or copolymer;

(b) a natural thickener capable of being readily dissolved in water at room temperature, based on an alginate or Guar bean flour, starch or cellulose derivative;

(c) a high-boiling hydrophobic solvent based on an alkyloxypropylate having the formula (I)

$$C_nH_{2n+2-m}[O(CH_2-CH(CH_3)O)_{x/m}-H]_m \quad (I)$$

in which formula n denotes an integer from 2 to 6, m denotes an integer from 1 to 6 and x denotes a number from 20 to 60, with the proviso that m is less than or equal to n, and with the proviso that said solvents of formula (I) or the mixtures thereof remain liquid between −5° C. and +220° C., have a viscosity between 20 and 240 cST at 50° C. and also have a density between 0.981 and 1.000 at 20° C; and (d) a viscosity-regulating emulsifier based on an polyglycol ester having the formula (II)

$$(CH_3)_a-C\left[CH_2-(O-CHZ-CH_2)_y-\begin{matrix}(OH)_b\\(O-CO-R)_{4-a-b}\end{matrix}\right]_{4-a} \quad (II)$$

in which R is an open-chain aliphatic radical having 9 to 19 carbon atoms, Z represents hydrogen and methyl, in the ratio of $H:CH_3$ of 2:1 to 4:1, a is zero or 1, b is 1 to 1.5, and (4-a).y is 150 to 300, wherein the thickener dispersion comprises- per total weight of the combination —from >0 up to 25% of the synthetic thickener (a); from >0 up to 25% of the natural thickener (b); from 35 to 75% of the solvent (c); and—per kilogram of the dispersion—from 10 to 100 g of the emulsifier (d).

2. The thickener dispersion as defined in claim 1 wherein the synthetic thickeners (a) are in the form of ammonium salts of high molecular weight polycarboxylic acids.

3. The thickener dispersion as claimed in claim 1, wherein the solvent of said component (c) provides a continuous phase in which the other components are homogeneously incorporated to form a dispersion.

* * * * *